US009802756B2

(12) United States Patent
Dunn et al.

(10) Patent No.: US 9,802,756 B2
(45) Date of Patent: Oct. 31, 2017

(54) CASSETTE FOR DISPENSING PLEATED TUBING

(71) Applicants: Steven Bryan Dunn, Beverly Hills, CA (US); Kevin Douglas Johnson, Tarzana, CA (US); Mark A. Hatherill, Beverly Hills, CA (US); Matthew Joseph Saxton, Agoura, CA (US)

(72) Inventors: Steven Bryan Dunn, Beverly Hills, CA (US); Kevin Douglas Johnson, Tarzana, CA (US); Mark A. Hatherill, Beverly Hills, CA (US); Matthew Joseph Saxton, Agoura, CA (US)

(73) Assignee: Munchkin, Inc., Van Nuys, CA (US)

( * ) Notice: Subject to any disclaimer, the term of this patent is extended or adjusted under 35 U.S.C. 154(b) by 0 days.

(21) Appl. No.: 14/960,182

(22) Filed: Dec. 4, 2015

(65) Prior Publication Data

US 2016/0083182 A1 Mar. 24, 2016

Related U.S. Application Data

(63) Continuation-in-part of application No. 13/688,139, filed on Nov. 28, 2012, now Pat. No. 9,085,404.

(60) Provisional application No. 62/087,640, filed on Dec. 4, 2014.

(51) Int. Cl.
*B65F 1/06* (2006.01)
*B65F 1/00* (2006.01)

(52) U.S. Cl.
CPC ..... *B65F 1/062* (2013.01); *B65F 1/0006* (2013.01); *B65F 2240/132* (2013.01)

(58) Field of Classification Search
CPC ... B65F 1/062; B65F 1/0006; B65F 2240/132
USPC ..... 220/495.07, 495.06, 908.1; 206/390, 206/389, 409
See application file for complete search history.

(56) References Cited

U.S. PATENT DOCUMENTS 4,783,206 A * 11/1988 Cullen ..... B01D 53/0415 206/204
4,869,049 A * 9/1989 Richards ..... B65B 9/15 53/370

(Continued)

FOREIGN PATENT DOCUMENTS

CA 2366384 6/2003
CA 2486136 5/2005

(Continued)

OTHER PUBLICATIONS

International Search Report, Mailed Feb. 4, 2016, (pp. 1-3).

(Continued)

*Primary Examiner* — Steven A. Reynolds
(74) *Attorney, Agent, or Firm* — Robert Z. Evora, Esq.; Christian Lek

(57) ABSTRACT

A cassette for use in dispensing a pleated tubing within a waste container. The cassette including an annular body having a generally U shaped housing with a central cylindrical core. An annular cover extends inward over the annular body defining a gap. The cover is secured to the body and at least one elongated boss is disposed on an outer surface of the cassette. The elongated boss extends is adapted to receive a key element capable of rotating, or preventing rotation of the cassette.

16 Claims, 14 Drawing Sheets

(56) References Cited

U.S. PATENT DOCUMENTS

| | | | | |
|---|---|---|---|---|
| 4,934,529 | A * | 6/1990 | Richards | B65B 9/15 206/303 |
| 5,590,512 | A * | 1/1997 | Richards | B65B 9/15 53/370 |
| 5,813,200 | A * | 9/1998 | Jacoby | B65B 67/1277 53/390 |
| 5,852,901 | A * | 12/1998 | Meyers | E02D 29/12 220/4.26 |
| 5,950,913 | A * | 9/1999 | Rea | B65D 3/24 206/499 |
| 7,694,493 | B2 * | 4/2010 | Stravitz | B65B 67/1277 53/138.7 |
| D615,786 | S * | 5/2010 | Morand | D6/515 |
| 7,743,588 | B2 * | 6/2010 | Webb | B65F 1/062 220/495.06 |
| 8,127,519 | B2 * | 3/2012 | Stravitz | B65F 1/0006 53/469 |
| 9,085,404 | B2 * | 7/2015 | Dunn | B65F 1/062 |
| 2003/0121923 | A1 * | 7/2003 | Morand | A47K 11/02 220/495.07 |
| 2005/0016890 | A1 | 1/2005 | Tannock | |
| 2005/0126130 | A1 | 6/2005 | Stravitz | |
| 2008/0272140 | A1 * | 11/2008 | Mowers | B65F 1/062 221/69 |
| 2009/0100806 | A1 * | 4/2009 | Morand | B65B 67/1277 53/567 |
| 2011/0099954 | A1 | 5/2011 | Cudworth | |
| 2014/0110293 | A1 | 4/2014 | Dunn et al. | |

FOREIGN PATENT DOCUMENTS

| | | |
|---|---|---|
| CA | 2387183 | 5/2009 |
| DE | 9319683 | 6/1994 |
| EP | 303517 | 2/1989 |
| EP | 699584 | 6/1996 |
| GB | 2221889 | 2/1990 |
| JP | 5429272 | 3/1979 |
| JP | 63123701 | 5/1988 |
| WO | WO9817536 | 4/1998 |
| WO | WO0220354 | 3/2002 |
| WO | WO03059748 | 7/2003 |
| WO | WO03068635 | 8/2003 |
| WO | WO2005/042381 | 5/2005 |
| WO | WO20091007723 | 1/2009 |

OTHER PUBLICATIONS

Written Opinion for PCT/US2015/064132, Mailed Feb. 4, 2016, (pp. 1-7).

International Search Report and Written Opinion for PCT/US2013/029555 dated Jul. 9, 2013 (pp. 1-10).

* cited by examiner

FIG. 17
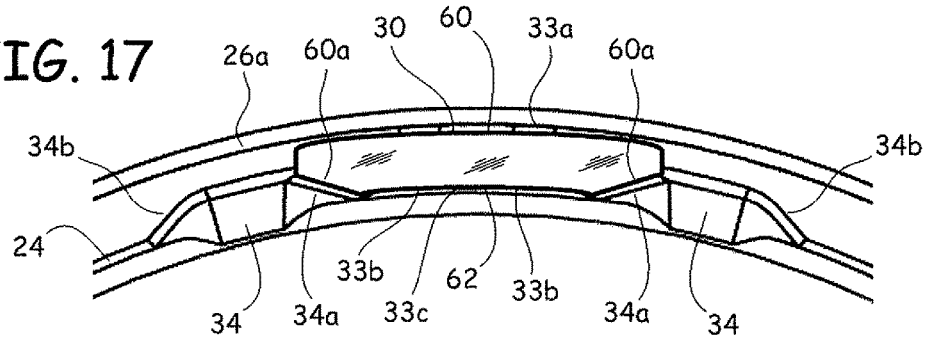
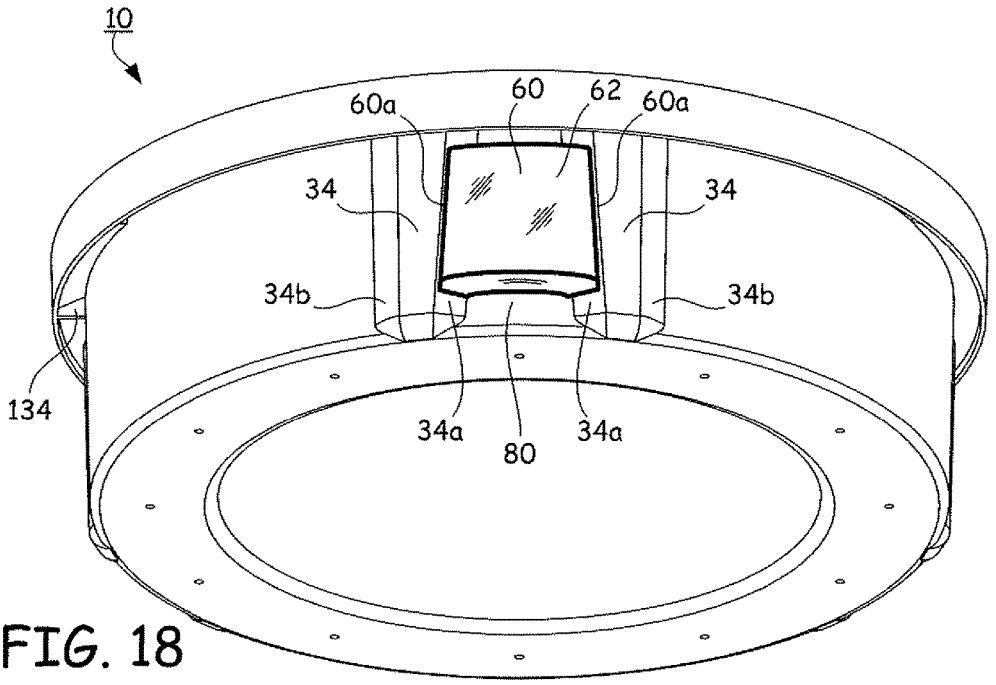
FIG. 18
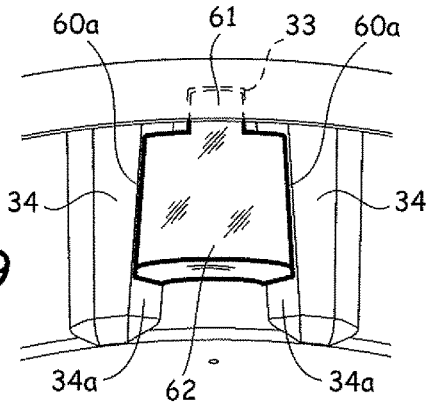
FIG. 19

CASSETTE FOR DISPENSING PLEATED TUBING

CROSS REFERENCE TO RELATED APPLICATIONS

This application incorporates and claims the benefit of the filing date of U.S. Patent Application Ser. No. 62/087,640, entitled "CASSETTE FOR DISPENSING PLEATED TUBING" filed Dec. 4, 2014 and U.S. patent application Ser. No. 13/688,139, entitled "CASSETTE FOR DISPENSING PLEATED TUBING" filed Nov. 28, 2012, the entirety of which is incorporated herein by reference.

TECHNICAL FIELD

The subject disclosure relates to a cassette used for dispensing pleated tubing. More specifically, to a cassette capable of storing a pleated tubing and adapted for use within a disposal container to collect waste refuse.

BACKGROUND

Various refillable cassettes have been provided for the disposal of waste material. Expired U.S. Pat. No. 4,934,529 to Richards et al. is an example of an apparatus applicable to the disposal of waste material. The cassette includes a resilient flexible tubing packed therein and covered by a secured radial cap.

U.S. Pat. No. 6,974,029 to Morand is another example of a conventional film dispensing cassette that requires the use of a tear-off projecting section disposed on its top portion having an outer edge engaging an upper part of the outer wall of the cassette body out of which a pleated tubing is withdrawn in a direction that is different from the Richards et al. reference cited above.

U.S. Pat. No. 7,743,588 to Webb is yet another example of a waste storage cassette device requiring a cassette rotator that is rotatably mounted in an upper part of the container in order to access the tubing stored therein.

Each of these conventional dispensers requires cumbersome techniques overcome by the disclosure below. Despite the ineffectiveness of these conventional attempts to provide a storage cassette, a need exists for a low cost, efficient storage container that can be conveniently assembled.

BRIEF DESCRIPTION OF THE DRAWINGS

Various exemplary embodiments of this disclosure will be described in detail, wherein like reference numerals refer to identical or similar components or steps, with reference to the following figures, wherein:

FIG. 17 depicts an exploded bottom view of a key disposed between adjacent elongated bosses in the lower annular body of the cassette.

FIG. 18 depicts an exploded lower view of a key disposed between adjacent elongated bosses in the lower annular body of the cassette.

FIG. 19 depicts a partial view of a key disposed between adjacent elongated bosses and an extended projection extending from the key into an opening in the lower annular body of the cassette.

DETAILED DESCRIPTION

Figure 1:
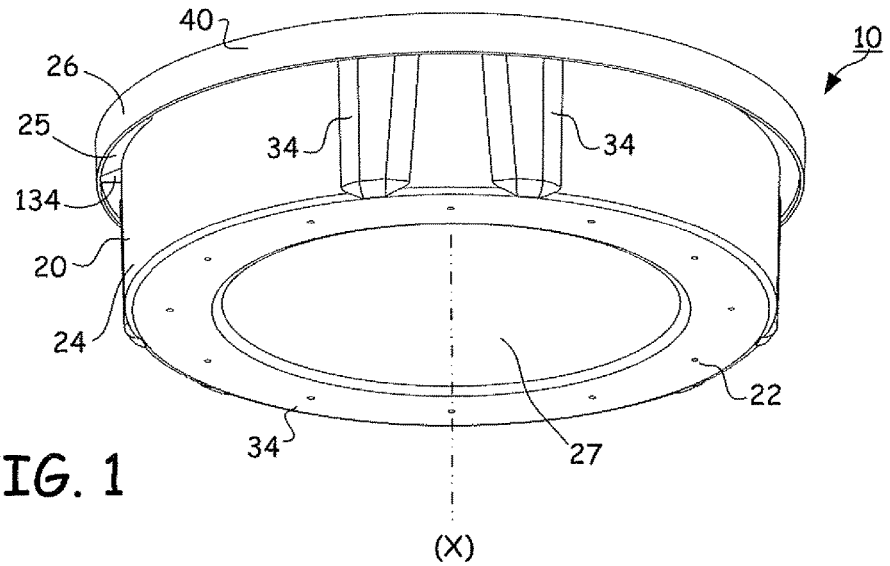
FIG. 1 illustrates a lower perspective view of an exemplary cassette according to the subject disclosure.

Particular embodiments of the present invention will now be described in greater detail with reference to the figures.

FIGS. 1-4 illustrate lower and upper perspective and exploded perspective views of an exemplary cassette 10 according to this subject disclosure. The cassette 10 is composed of a lower annular body 20 having a generally U-shaped cross-section compartment and an annular cover 40 that extends over a portion of the U-shaped channel cross-section compartment. Various enlarged bosses 34 extends axially (X) lengthwise along an outer wall 24 of the lower annular body 20.

Figure 5:
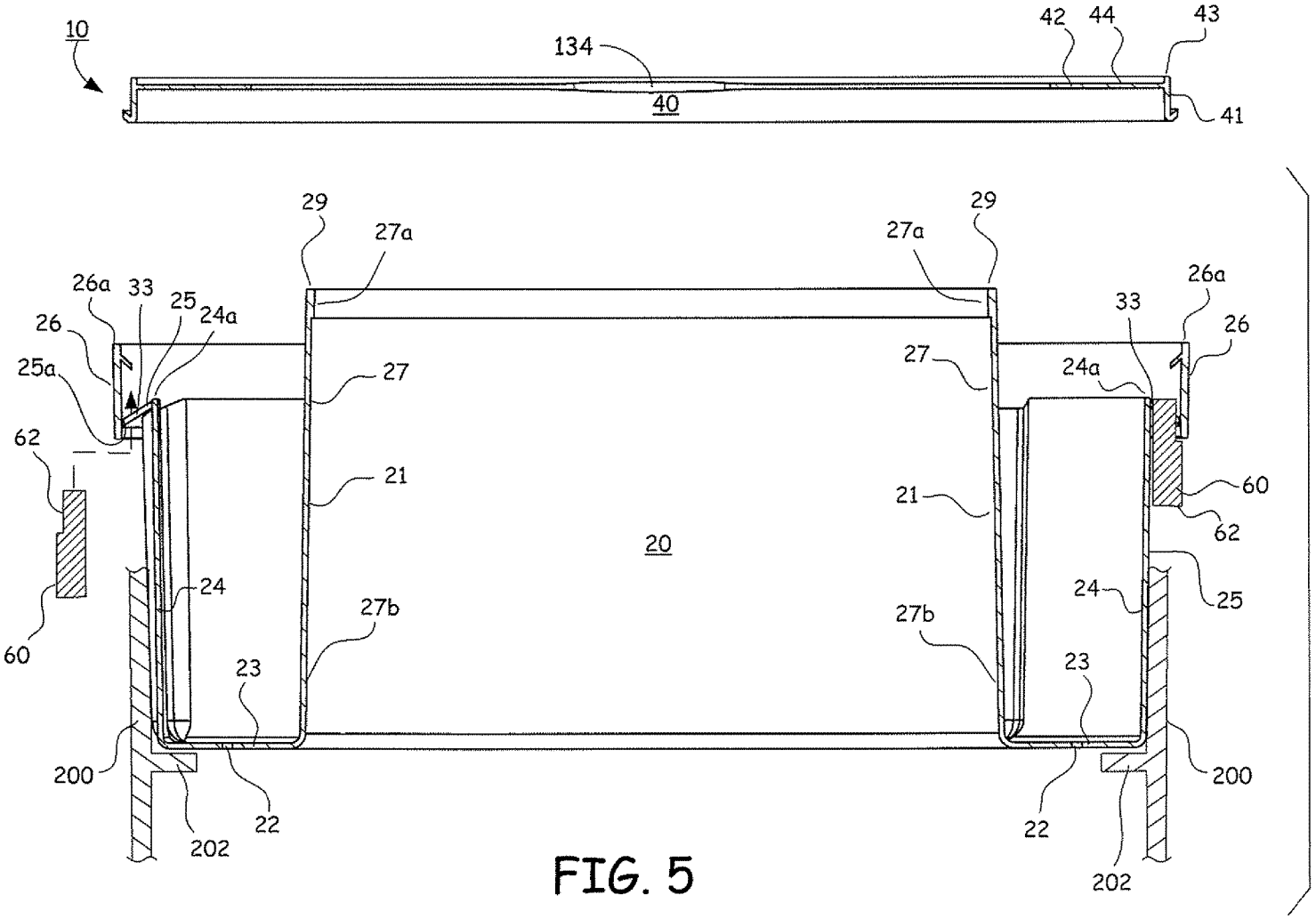
FIG. 5 illustrates an exploded cross section side view of the annular cover and annular body of the cassette disposed in a support.

FIG. 5 depicts an exploded cross section view of the cassette 10. The lower annular body 20 includes an inner wall 21 connected to a bottom wall 23. The bottom wall 23 is connected to the outer wall 24.

Figure 6:
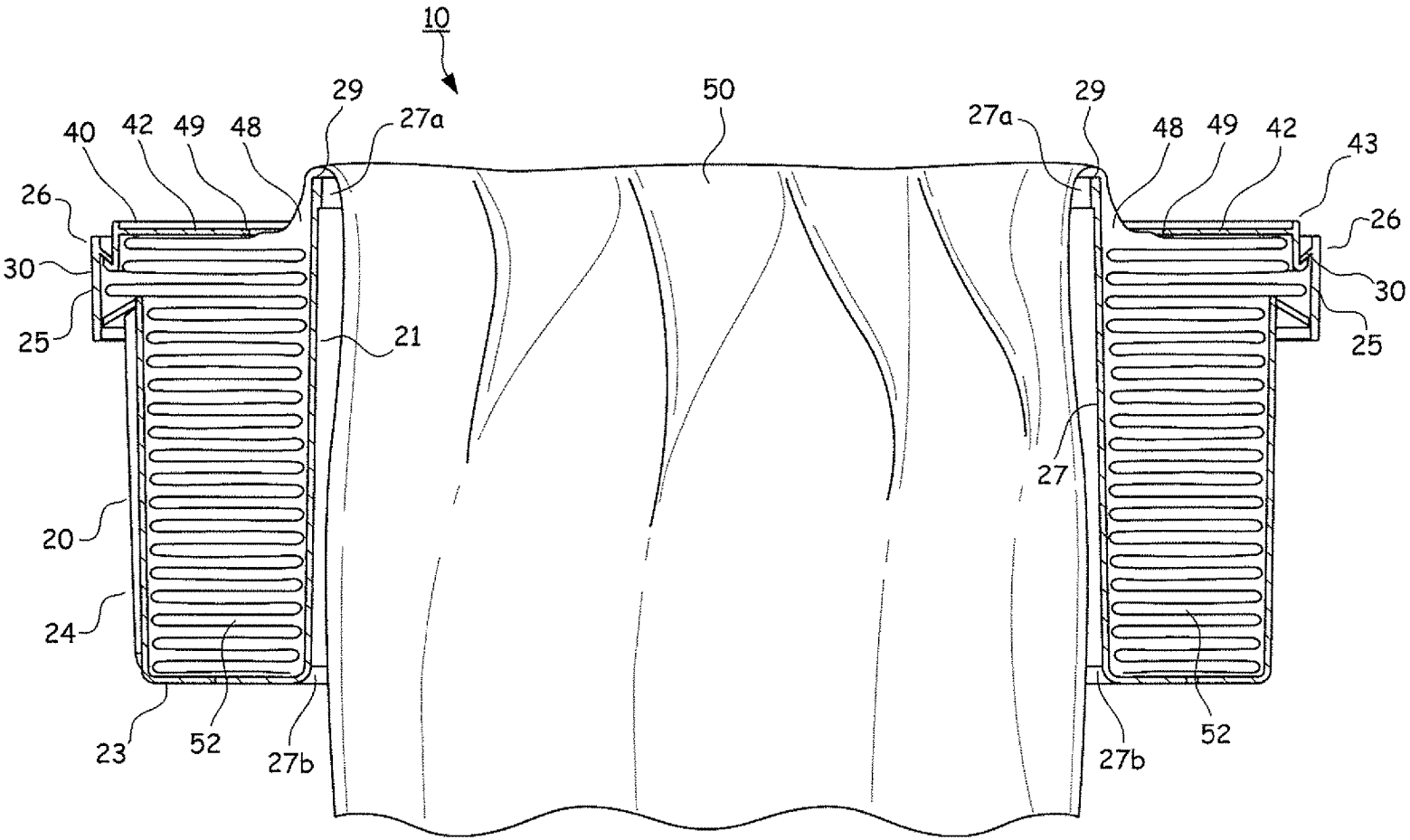
FIG. 6 shows a cross section view of the cassette having a flexible tubing disposed therein.
Figure 8:
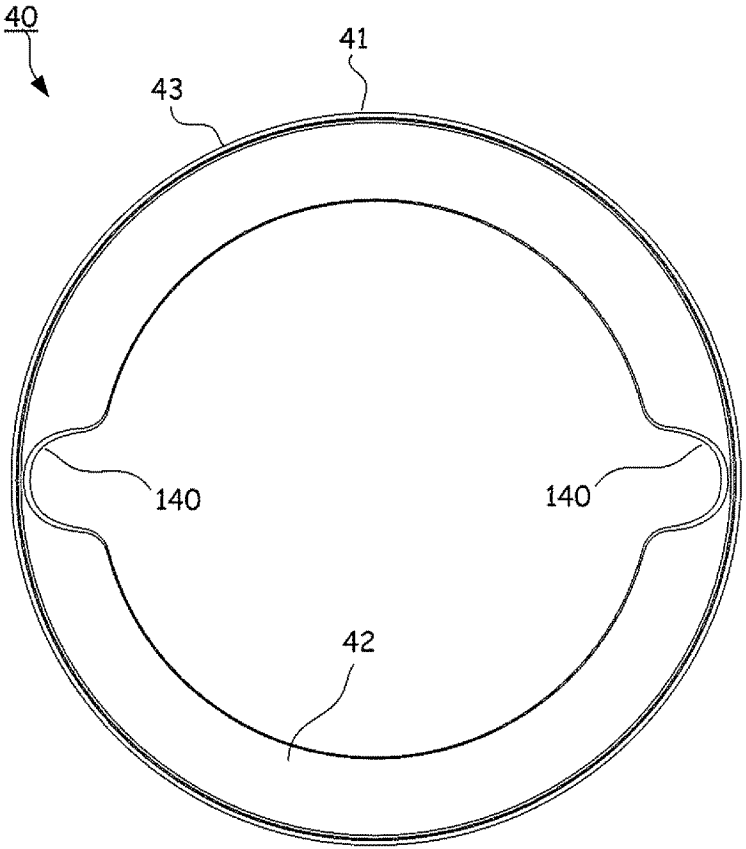
FIG. 8 shows a top view of the annular cover.
Figure 7:
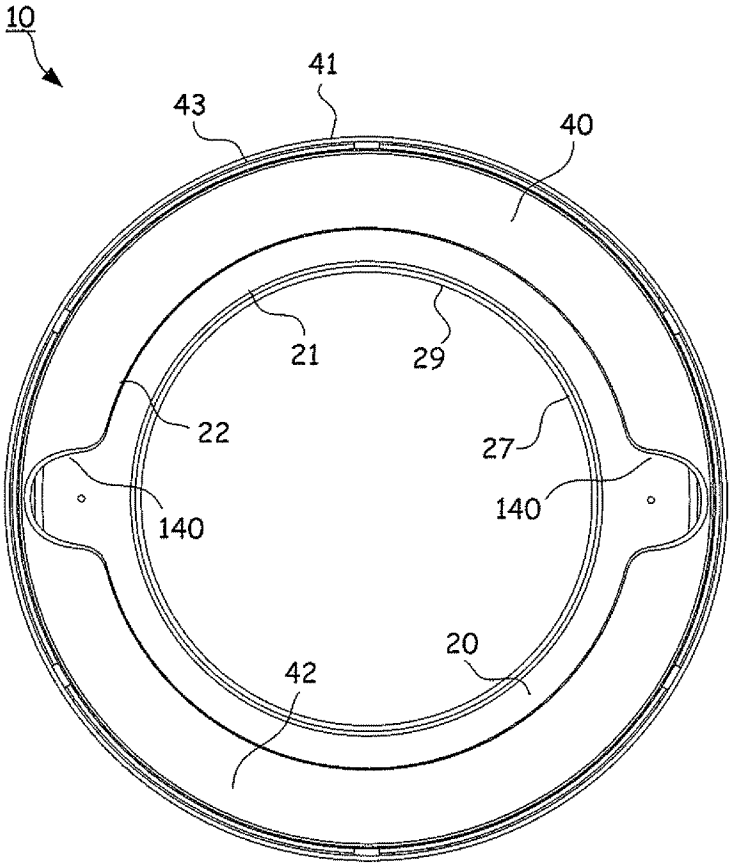
FIG. 7 depicts a top view of the cassette.

An outward extending wall 25 is provided at an upper end 24*a* of the outer wall 24. The outward extending wall 25 terminates at a peripheral end 25*a* at an upper outer wall 26. The inner wall 21, the bottom wall 23, the outer wall 24, the outward extending wall 25 and the upper outer wall 26 collectively form the U-shaped channel cross-section of a housing into which a pack 52 of a pleated flexible tubing 50 is received, as shown in FIG. 6.

As shown in FIG. 5, the cassette 10 is held by a support member 200 in use. An extended surface 202 may be provided to extend horizontally from the support member 200 to define a flat shelf or ledge or surface onto which the lower wall 23 of the U-shaped annular body 20 may be supported.

One or more apertures 22 may be provided in the bottom wall 23 of the lower annular body 20, or various locations in the lower configuration of the U-shaped channel cross-section. The apertures 22 may be provided to allow air to escape during the packing of the flexible tubing 50 into the lower annular body 20. As shown in FIG. 6, the flexible tubing is packed into the U-shaped annular body 20 as a pleated packed tubing 52.

Referring to FIG. 5, the U-shaped annular body 20 encircles the central cylindrical core 27. That is, the inner wall 21 of the annular body 20 defines the central cylindrical core 27 opening having a cylindrical open top 27*a* and a cylindrical open bottom 27*b* construction. As shown, an upper edge 29 of the cylindrical open top 27*a* may be constructed to extend above an upper end 26*a* of the upper outer wall 26.

As shown in FIG. 6, and described in more detail later, the tubing 50 is shown as a pleated packed tubing 52 disposed in the U-shaped channel cross-section of the lower annular body 20. The packed tubing 52 is adapted to be received and pulled upward from within the U-shaped channel pass the annular cover 40, over an upper edge 29 of the inner wall 21 and downward through the central cylindrical core 27 opening.

As shown in FIG. 5 and particularly FIGS. 9-10, the annular cover 40 has an outer cylindrical wall 41 and an inwardly extending ledge 42 that begins extending slightly below a top edge 43 of the outer cylindrical wall 41 thereby defining a concentric top rim 44 in the annular cover 40. When positioned over the lower annular body 20, the ledge 42 extends from the cylindrical outer wall 41 inward and towards, but not as far as, the inner wall 21 of the central cylindrical core 27 to define opening 48 as shown in partial cross section in FIG. 9.

FIGS. 9-12 illustrate the cylindrical outer wall 41 of the annular cover 40 having a lower end 45 that is capable of being cooperatively received inside of an inner surface 28 (shown in FIGS. 9-10) of the outer wall 26 of the U-shaped channel of the lower annular body 20. In particular, an annular upturned lip 46*a* of a V-shaped groove 46 is formed at a lower end 45 of the outer wall 41 of the annular cover 40. As shown in FIGS. 9-12, the annular V-shaped groove 46 interlocks with a protruding tongue 30 defined in the upper outer wall 26 of the lower annular body 20.

Figure 9:
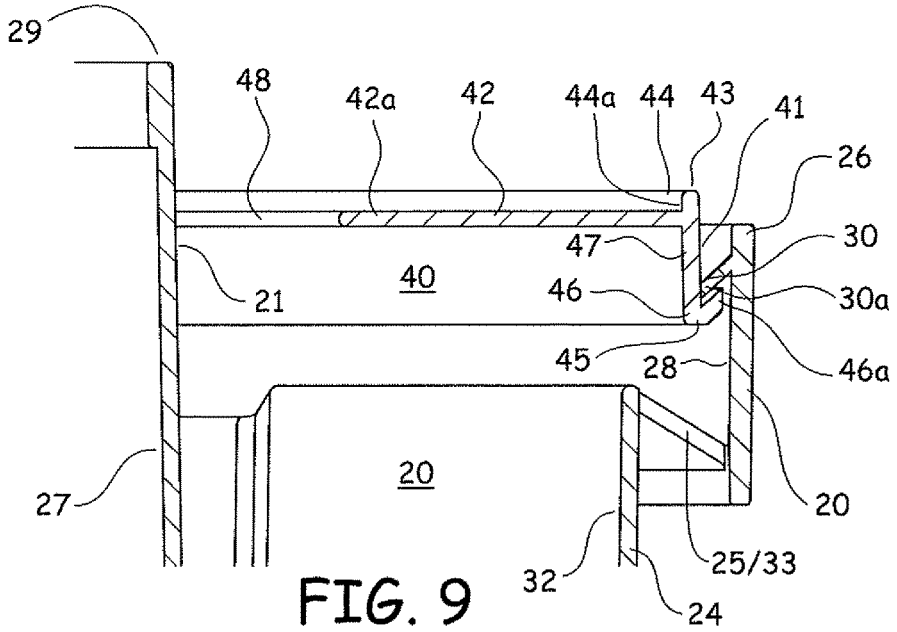
FIG. 9 depicts a partial exploded side cross section view of the annular cover connected to the annular body of the cassette.
Figure 10:
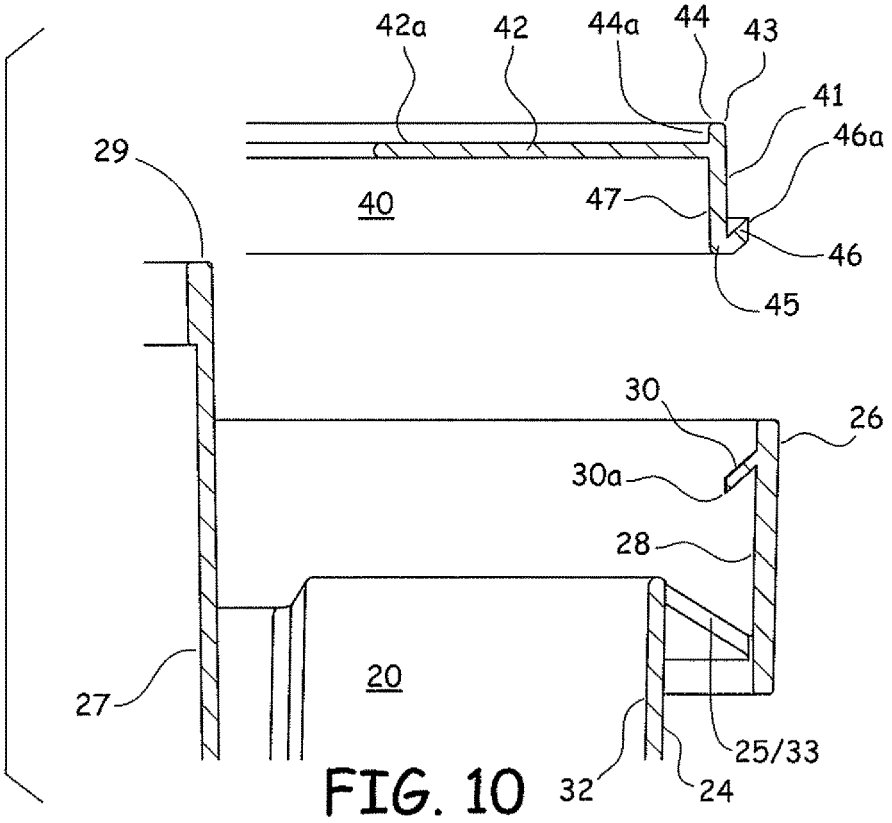
FIG. 10 illustrates an exploded partial side cross section view of the annular cover and annular body of the cassette.
Figure 12:
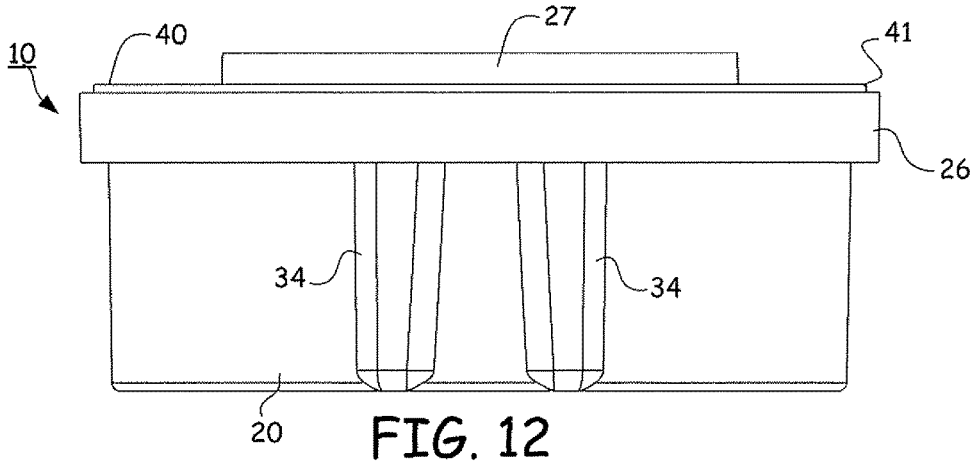
FIG. 12 depicts a side view of the annular cover secured by the tongues onto the annular body of the cassette.

In place, the annular cover 40 and the lower annular body 20 are lockingly engaged to one another as shown in FIGS. 9 and 12. To prevent the annular cover 40 from being disconnected from within the upper outer wall 26 of the lower annular body 20, the annular cover 40 is lowered and positioned within the upper edge of the expanded outer wall 26 of the annular body 20 so that an outer edge of the upturned lip 46*a* of the annular V-shaped groove 46 slides past a lower edge 30*a* of the protruding tongue 30 as shown in FIG. 9.

The upturned lip 46*a* of the annular V-shaped groove 46 is then locked against an outermost edge 30*a* of the protruding tongue 30. The protruding tongue 30 functions as a detent. When the V-shaped groove 46 is lowered below the lower edge 30*a* of the protruding tongue 30, the annular cover 40 is mechanically arrested against a lower outermost edge 30*a* of the protruding tongue 30 and cannot be undesirably lifted or raised off of the lower annular body 20 after the annular V-shaped groove 46 has been securely mounted against the protruding tongue 30.

FIGS. 9, 10, 13A, 13B and 13C show at least one inter-engagement mechanism construction in which the protruding tongues 30 cooperate as the inter-engagement mechanism, such as a detent mechanism. Protruding tongues 30 may be distributed along an inside surface 28 of the upper outer wall 26 of the lower annular body 20. Various openings 33 are provided in the outward extending wall 25 and may be positioned just below the various protruding tongues 30. The various openings 30 can be formed with a piercing tool (not shown).

Figure 13A:
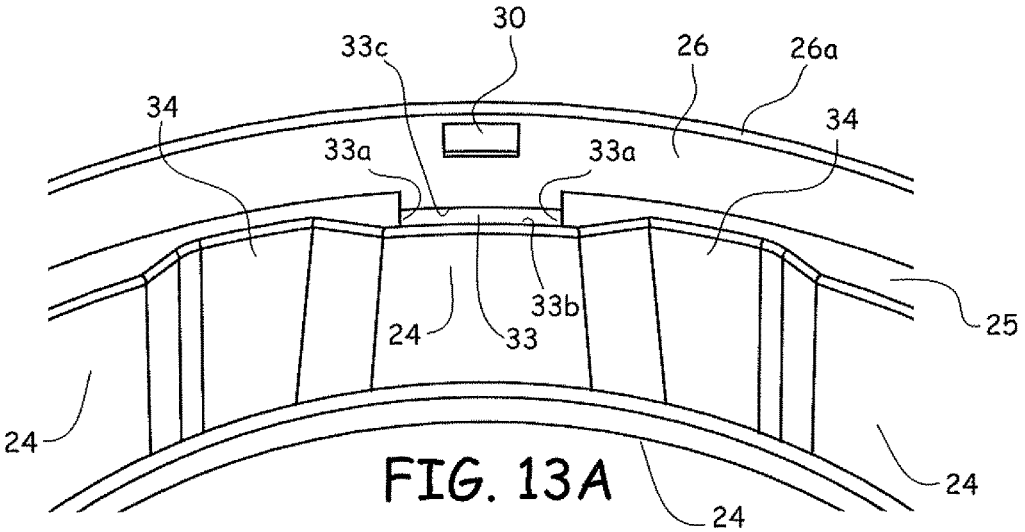
FIG. 13A shows a partial exploded view of a top perspective view of the openings in the lower annular body of the cassette.
Figure 13B:
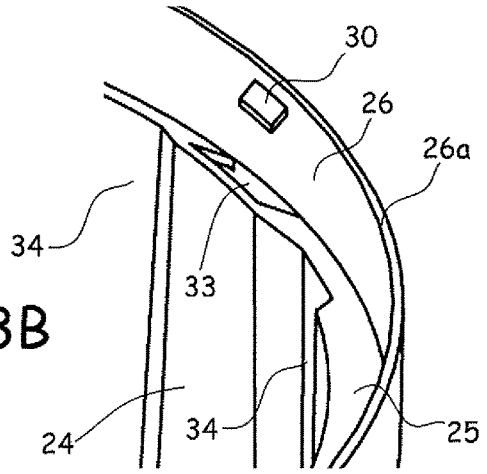
FIG. 13B shows an exploded view of the exploded B-B section in FIG. 4 view of an angular top perspective view of the openings in the lower annular body of the cassette.
Figure 13C:
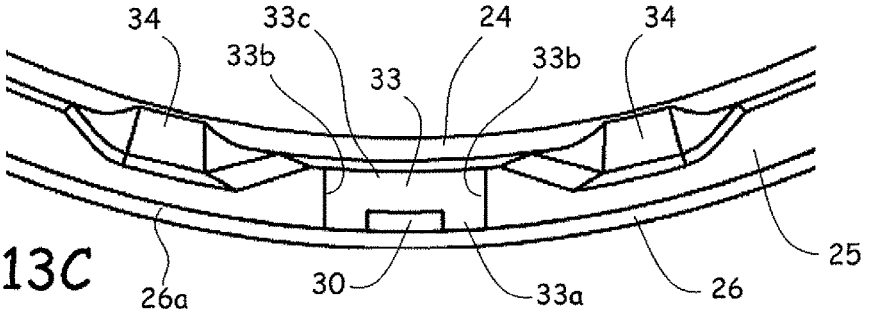
FIG. 13C shows an exploded view of the exploded C-C section in FIG. 16 of a lower view of the openings in the lower annular body of the cassette.

FIGS. 13A, 13B and 13C show various views of the inter-engagement mechanism provided on the lower annular body 20. That is, the tongues 30 protrude inwardly around the inner surface of the outer wall 26 of the annular body 20. However, it is to be understood that any other suitable construction for the inter-engagement mechanism is possible.

It is to be understood that various other alternatives and/or constructions may exist for the cooperating inter-engagement mechanism that secures the annular cover 40 to the annular body 20. For example, providing mating raised protrusions on the annular cover 40 that cooperate with protrusions on the annular body 20 to secure the annular cover 40 to the annular body 20. After the associated mating protrusions have passed over each, the annular cover 40 can be locked in place to the annular body 20.

Figure 14:
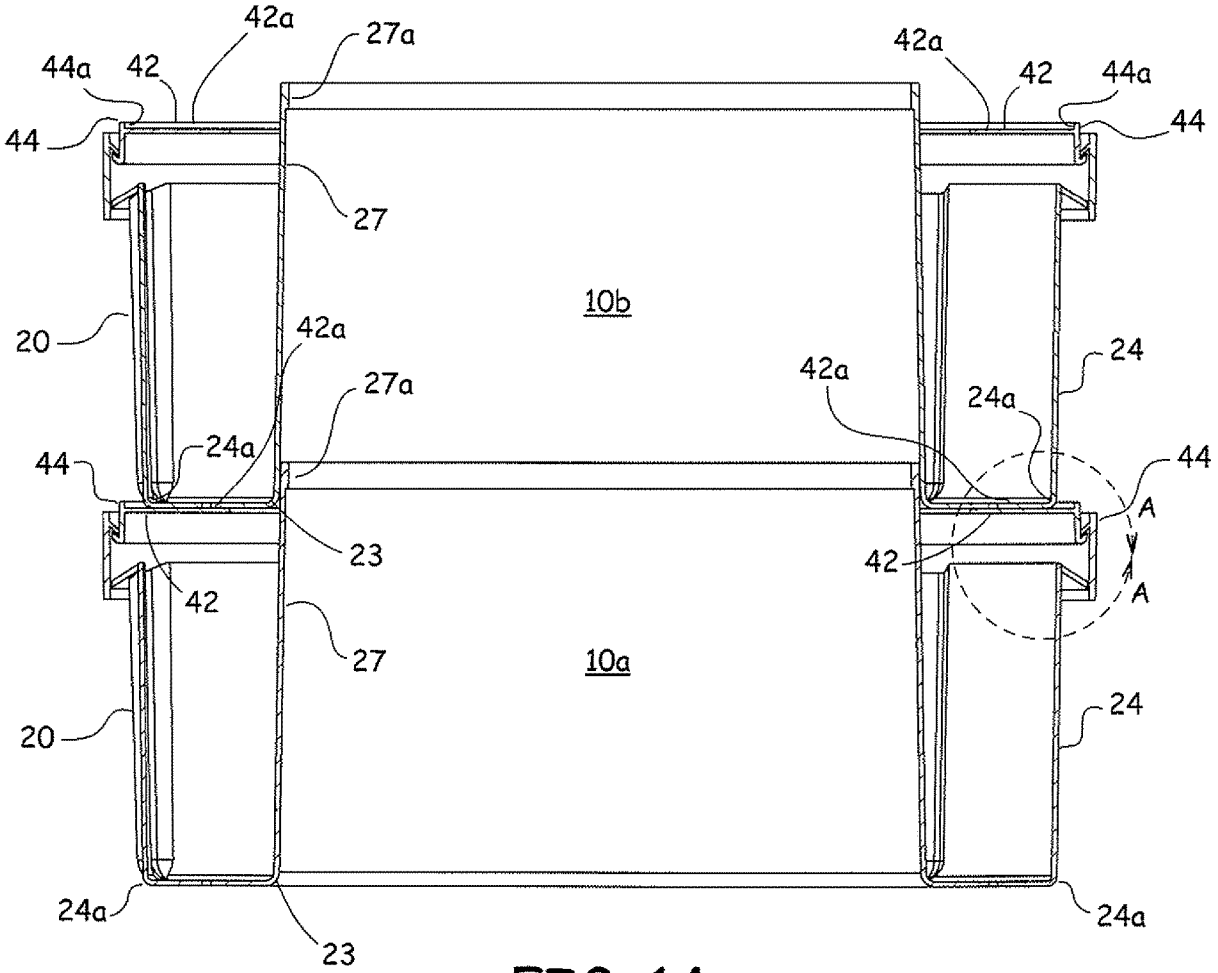
FIG. 14 illustrates a cross section view of a pair of stacked cassettes according to this disclosure.
Figure 15:
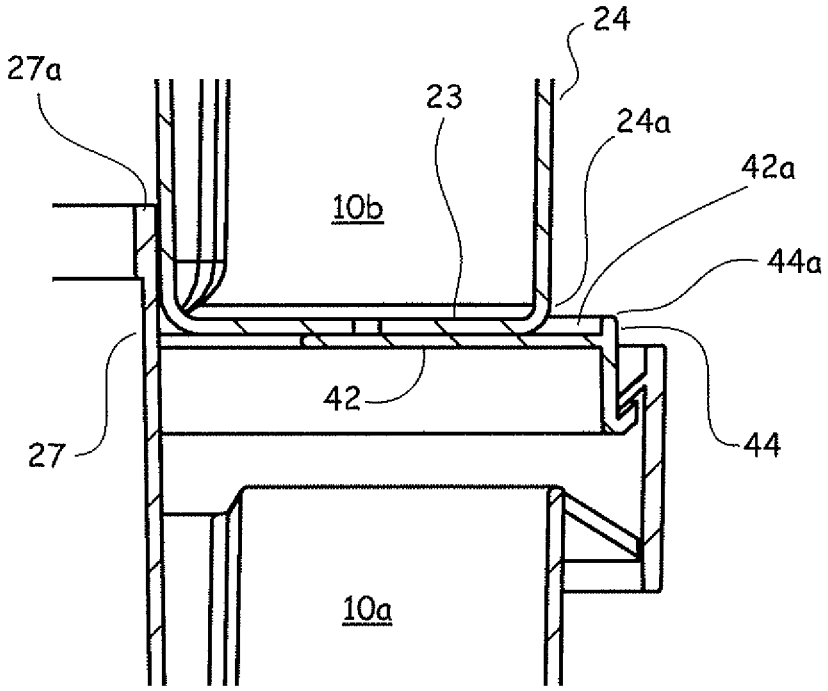
FIG. 15 depicts an enlarged cross section view of the exploded A-A section in FIG. 14 of a concentric lip aligning the pair of stacked cassettes according to this disclosure.
Figure 16:
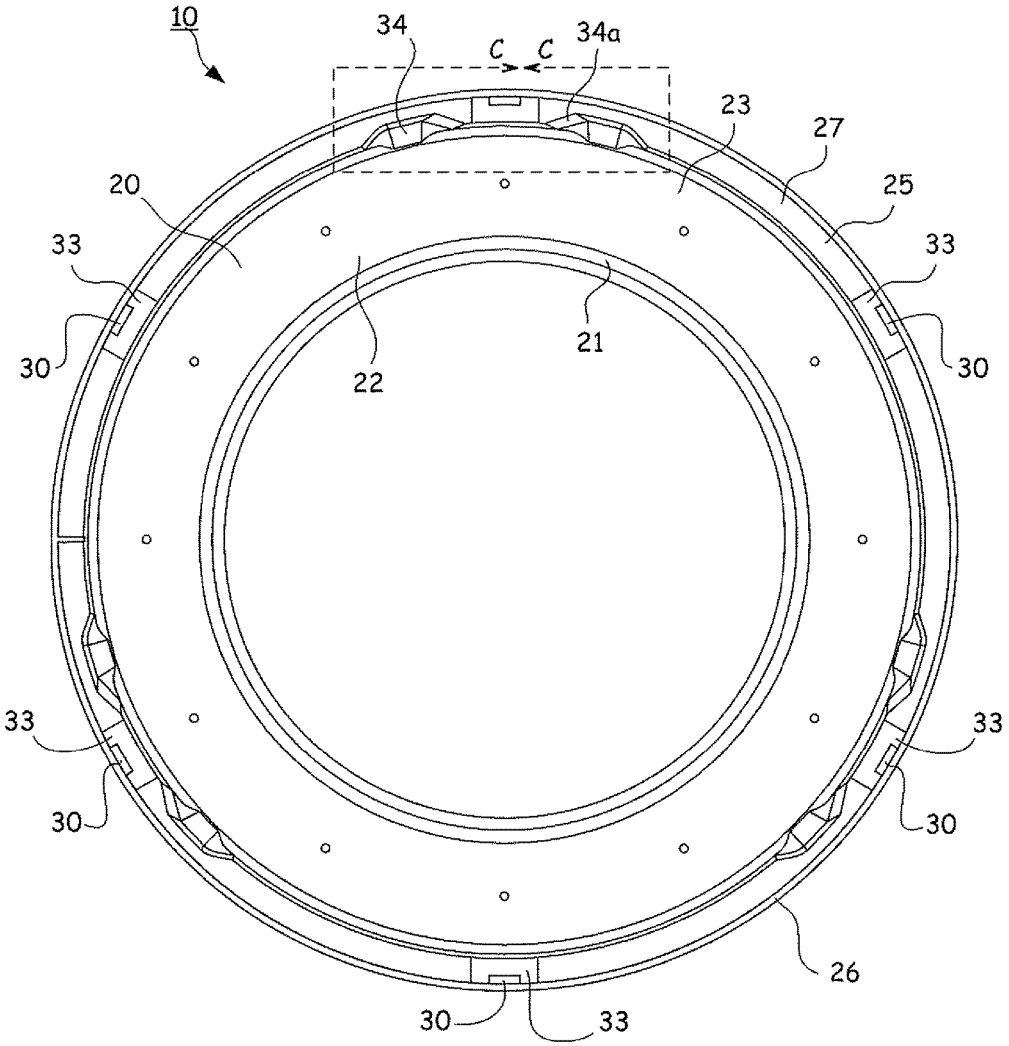
FIG. 16 shows a bottom view of the annular body and apertures in the cassette.

FIG. 14 shows a pair of cassettes 10*a*, 10*b* stacked, one on top of the other. As shown in FIG. 15 (the exploded A-A section in FIG. 14), the concentric top lip or rim 44 and top end 27*a* of the inner wall 27 function as concentric boundaries onto which the bottom wall 23 of the lower end of the annular body 20 is placed and supported in the stacking configuration such as shown for the cassettes 10*a*, 10*b* located on top of each other. As shown in FIGS. 9-10 and 14-15, an upper surface 42*a* of the ledge 42 is constructed in a substantially horizontal configuration. The upper surface 42*a* of the ledge 42 is strong enough to hold the weight of various cassettes stacked on top of each other, such as the two stacked cassettes 10*a*, 10*b* shown and/or more.

FIGS. 14-15 further depict the outer circumference of the lower edge 24*a* of the outer wall 24 being dimensioned to fit within the inner circumference surface edge 44*a* of the concentric top rim 44 and the upper end 27*a* of the inner wall 27. According to this construction shown in FIG. 14, the second cassette 10*b* may be stacked on top of a lower first cassette 10*a* in a secure manner. That is, the lower edge 24*a* of the outer wall 24 is dimensioned to be held securely in place between the inner diameter of the inner surface edge 44*a* of the raised concentric top rim 44 and the upper end 27*a* of the inner wall 27. This construction prevents the stacked second cassette 10*b* from sliding off of a top surface 42*a* of the ledge 42 of the annular cover 40 of the lower cassette 10*a* as it sits on an upper side of the lower annular cover 40 of the lower cassette 10*a*.

Referring back to FIG. 6 in more detail. In construction, the tubing 50 is tightly bunched into the U shaped channel of the cassette 10 between the inner wall 21, the bottom wall 23 and the outer wall 24 into a compressed mass or tubing pack 52 of profusely and tightly pleated layered tubing 50. The tubing 50 may be for example, a high density polyethylene tubing and/or any other suitable material composition in accordance with the subject disclosure. After the flexible tubing 50 has been packed 52 into the U-shaped casing of the lower annular body 20, the annular cover 40 is placed over the pleated pack 52 of tubing 50.

As shown in FIGS. 6 and 9-12, during installation, when the annular cover 40 is mounted and recessed onto the annular body 20, the packed tubing 52 that is pleated and bunched into the lower annular body 20 is slightly compressed by the annular cover 40 when installed. When the annular lip 46*a* of the annular V-shaped groove 46 slides past the lower edges 30*a* of the protruding tongues 30, the downward pressure applied to the annular cover 40 is then released and allowed to retract back upward so that the annular lip 46*a* of the annular V-shaped groove 46 can lockingly engage with the downturned edges 30*a* of the protruding tongues 30 as shown in FIG. 9. The annular cover 40 and the lower annular body 20 are lockingly engaged to one another by means of the cooperation of the series of tongues 30 having a size and shape adapted to snap into engagement onto the annular lip 46*a* of the V-shaped groove 46.

In FIG. 9, an inner cylindrical surface 47 of the outer wall 41 of the annular cover 40 is constructed to have substantially the same diameter dimension as the inner cylindrical surface 32 of the outer wall 24 of the annular body 20. Providing substantially similar dimensions between the inner cylindrical surface 47 of the cylindrical outer wall 41 and the inner cylindrical surface 32 of the outer wall 24 will prevent the packed tubing 52 from being pinched, snagged or torn during the packing assembly and/or use when the packed tubing 52 is unraveled and the tubing 50 is drawn from within the cassette 10.

FIGS. 13A, 13B, 13C and 16 show the plurality of apertures or openings 33 disposed in a radial configuration in the outward flared angular wall 25 on the annular body 20. As shown, the openings 33 may be constructed radially elongated in shape or any other suitable shape. As shown, the openings 33 have shorter sides 33*b* bounded by longer sides 33*a*, 33*c*. The inner longer side 33*c* lies adjacent to the outer wall 24, and the outer longer side 33*a* is adjacent to the upper outer wall 26. The openings 33 are cut into the angular wall 25 and disposed concentrically about in a radial pattern between the upper outer wall 26 and the outer wall 24. The openings 33 are provided in the area between adjacent elongated bosses 34. However, it is to be understood that the openings 33 may be placed anywhere in, or between, the upper outer wall 26 and the outer wall 24.

One advantage of the openings 33 is to provide the ability to control the rotation of the cassette 10 as shown in FIGS. 5 and 19. The openings 33 may function as key holes into which a mating key 60 and/or extension 61 of a rotation mechanism 62 can be used to control the rotation of the cassette 10 during operation of a unit (such as a waste receptacle) into which the cassette 10 may be placed and used. That is, a key 60 may be aligned to mate with at least one of the openings 33. The key 60 may engage any portion of the opening 33 on any wall 21, 23, 24 surface to cause the cassette 10 to rotate, or to prevent the cassette 10 from rotating by arresting the movement of the cassette 10.

That is, the key 60 of the rotation mechanism 62 may be engaged with any of the various surfaces 33*a*, 33*b*, 33*c* of the openings 33 to grip the cassette 10 and cause the cassette 10 to rotate or prevent it from rotating. The keys 60 may be integrated as part of the support 200 structure (as shown in FIG. 5), an intermediate component like the collar 90 shown in FIGS. 20-21 or some other part of the waste container unit that holds the cassette 10.

The openings 33, protruding tongues 30, the shelf itself created by the outward flared angular wall 25, the expanded outer wall 26, the construction of the enlarged bosses 34 and the like, can all be used for various purposes, such as to secure and/or grab onto the cassette 10 and secure it in a preferred position.

Likewise, these various features can be used to position the cassette 10 at a predetermined height within the unit in addition to functioning as various key holes and/or contours into which a mating key 60, 61 or shape of a rotational mechanism 62 can be engaged to cause the cassette 10 to rotate or prevent the cassette 10 from rotating.

FIGS. 17 and 18 show that the key 60 may be embodied in a variety of sizes, shapes and configurations. As shown, the key 60 is a substantially flat curved semi rectangular element that fits in a space 80 disposed between two adjacent enlarged bosses 34. The construction is such that outer ends 60*a* of the key 60 have mating contours to snugly fit within the outer surface contour 34*a* of adjacent elongated bosses 34. The fit between the outer ends 60*a* of the key 60 and the outer surface contour 34*a* of the elongated bosses 34 are substantially close to cause the cassette to rotate or prevent movement dictated by the movement of the key 60. Although shown in the space 80 between proximally closer bosses 34, the key 60 can be adapted to fit outside of the proximally located bosses 34 against outer surface contour 34*b* and/or any other suitable location.

FIG. 19 depicts another construction for the key 60 including an extension 61 which is capable of extending into the recess 33 as another method for locking the key 60 in a predetermined position. With the extension 61 in place, the rotational position of the cassette 10 can be easily manipulated. As shown, the key 60 may be an independent element that works in conjunction with the container unit and the cassette 10. Alternatively, the key 60 may be incorporated with a removable element, such as a removable collar 90 as shown in FIGS. 20-21.

Figure 20:
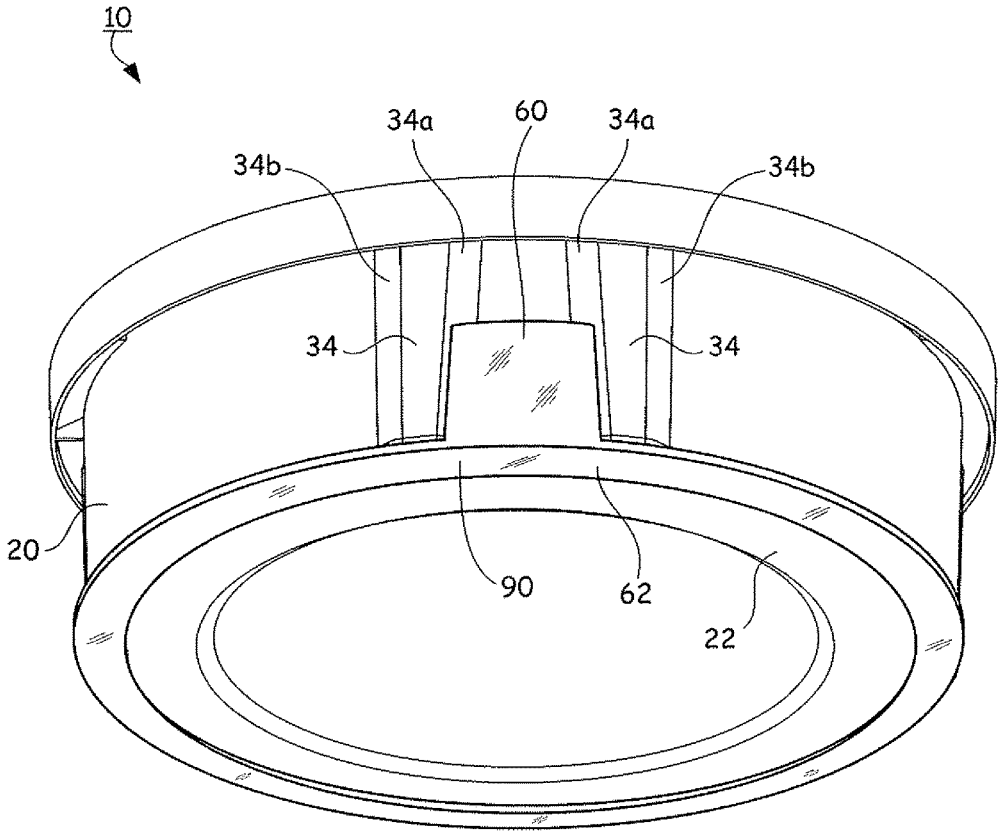
FIG. 20 depicts a lower perspective view of a collar having a key disposed between adjacent elongated bosses in the lower annular body of the cassette.

FIG. 20 shows the key 60 integrated into a collar 90 that may be removed. The collar 90 can be constructed and adapted to fit around, below and/or at various positions surrounding the cassette 10. As shown, the collar 90 rests partially below the lower wall 22 of the lower annular body 20 and the key 60 extends upward therefrom between two adjacent elongated bosses 34.

Figure 21:
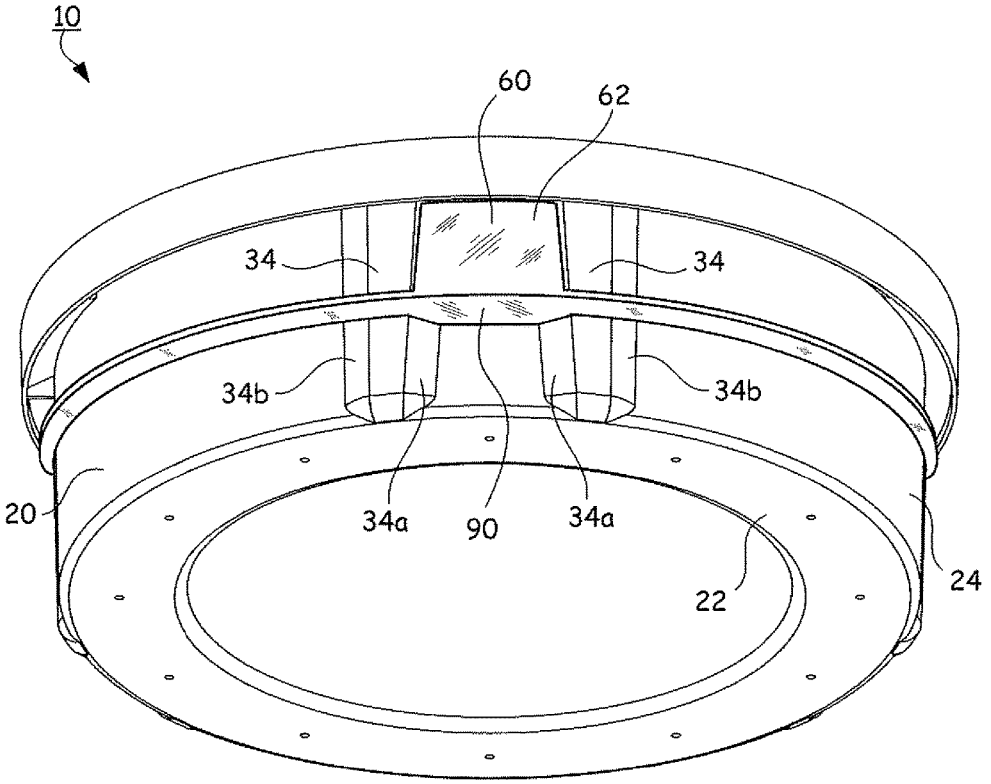
FIG. 21 depicts a lower perspective view of a collar having a key disposed between adjacent elongated bosses at a midpoint along an outer wall of the lower annular body.

FIG. 21 depicts another embodiment for the collar 90 in which the collar 90 encircles the lower annular body 20 at a positioned along the side outer wall 24 between the lower wall 22 and the upper end of the outer side wall 24. As shown, the key 60 of the collar 90 rests between two adjacent elongated bosses 34.

The collar 90 may be provided to allow the cassette to be retrofitted into a variety of different units (such as various diaper pails) of various sizes and shapes. The collar 90 and its construction thereof may be integrated as a portion of the cassette 10. As shown in FIG. 20 and FIGS. 17-19, the collar 90 may leverage the use of the openings 33, the outward flared angular wall 25, the bosses 34 and/or any other contour in order to secure a firm grasp there onto or fasten to the cassette 10 and provide an extension capable of making the cassette design universally adaptable for a variety of different units.

Referring back to FIGS. 2, 4 and 7-8, curved indentations 140 are formed in the inward extending wall 42 of the cover 40. Providing there is sufficient friction, and/or locking, between the annular cover 40 and the annular body 20, the curved indentations 140 may be provided as indexing notches adapted to allow, or restrict, rotation of the cassette 10 by engaging the curved indentations 140 in the cover 40. For example, a user can manually rotate the cassette 10 by placing their fingers into the open space within the curved indentations 140 and manually turn the cassette via the curved indentations 140 in the annular cover 40.

Figure 2:
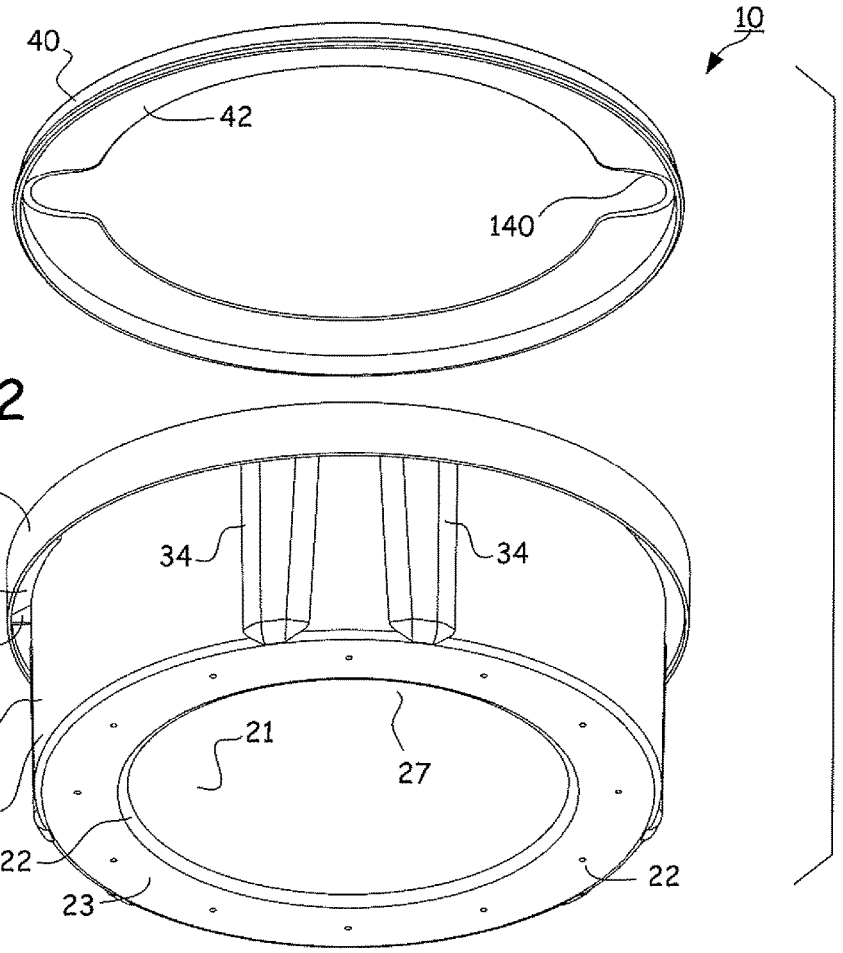
FIG. 2 depicts an exploded lower perspective view of an annular cover and annular body of the cassette according to the subject disclosure.
Figure 3:
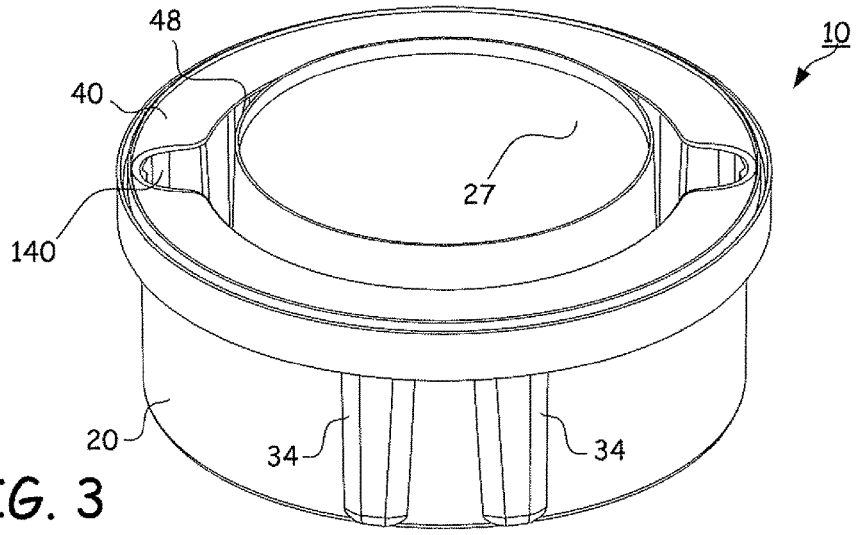
FIG. 3 illustrates an upper perspective view of the cassette.
Figure 4:
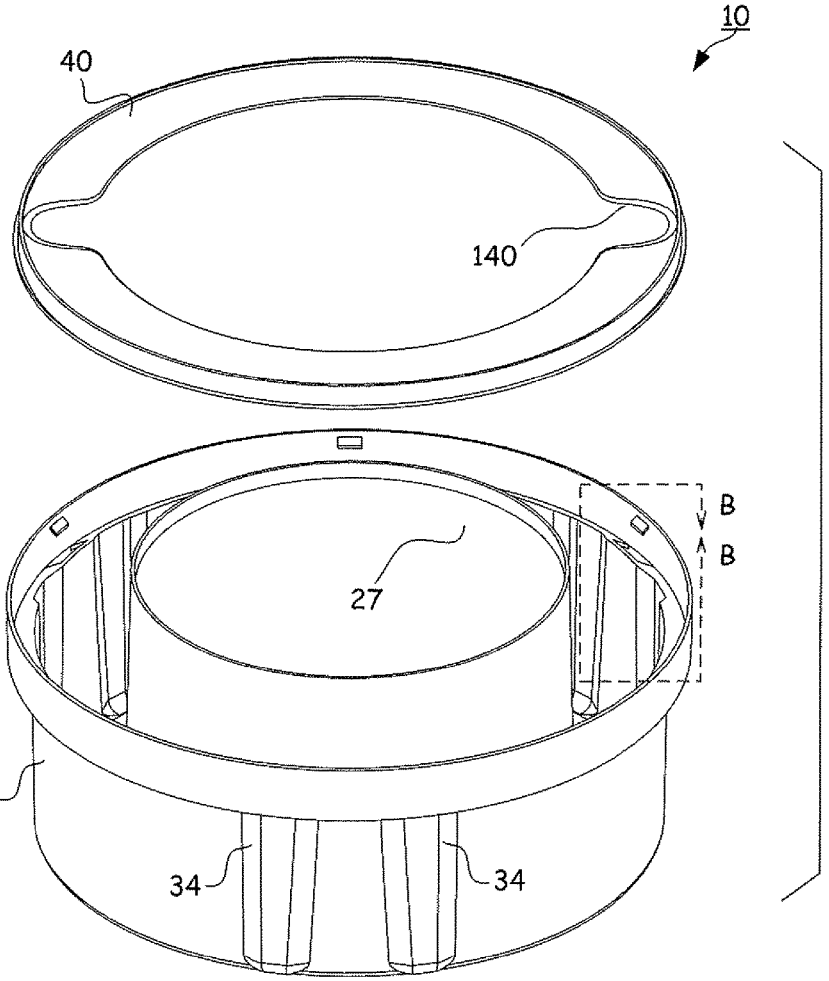
FIG. 4 depicts an exploded upper perspective view of the annular cover and annular body of the cassette.

One or more indexing webs 134 illustrated in FIGS. 1-2 and 18 may also be incorporated into the lower annular body 20 for alignment and/or positioning of the cassette 10 within the waste container. As shown, the indexing web 134 is provided in an area bounded by the outer wall 24, the outward flared wall 25 and the expanded outer wall 26. However, it is to be understood that the indexing web 134 may be positioned in a variety of locations on the cassette 10. The keys 60 and/or the collar 90 may be adapted for use with the indexing web 134.

The positioning of the height of the cassette 10 disposed within the unit (such as a waste disposal unit) into which the cassette 10 is placed may be varied by as plurality of different parameters. The various parameters, may include, but are not limited to: lengthening or shortening the height of the outer wall 24; the position where the outward flared angular wall 25 meets the outer wall 24; the length, height and angle of the outward flared angular wall 25; and/or the length of the expanded outer wall 26. A plurality of various other design parameters may also be manipulated to vary the height positioning of the cassette 10 in the unit it is to be used therewith.

Although the openings 33 are shown as equidistant symmetric elongated rectangular slots extending across the outward flared angular wall 25, it is possible to vary the number of openings 33, their placement, the size and/or shape of the various openings 33 to any number, size, symmetry or shape according to this subject disclosure. Likewise, is it also possible to extend the openings 33 into the outer wall 24, or alternatively provide the openings 33 into any one, or more, of the surrounding walls.

Referring back to FIG. 6, the cassette 10 is depicted in cross section with the flexible tubing 50 being drawn from within the U-shaped lower annular body 20. In use, the cassette 10 may be mounted to a support 200 in a device or unit (as shown in FIG. 5), such as a waste container. The flexible tubing 50 may be first retrieved from within the U-shaped lower annular body 20 through an opening 48 defined between a peripheral edge 49 of the inwardly extending ledge 42 of cover 40. The flexible tubing 50 is then pulled over the outer smooth upper edge 29 of the inner wall 21 of the body 20.

A knot may be made close to the initially pulled end of the flexible tubing 50 to tie off one end. The knotted end of the flexible tubing 50 may then be pulled or pushed (if the end of the tubing is first closed) through the central cylindrical core 27 opening. The flexible tubing 50 is withdrawn from the pack tubing 52 in the U-shaped lower annular body 20 through the opening 48 defined between the peripheral edge 49 and the central cylindrical core 27 opening, and then over the smooth top edge 29 of the central cylindrical core 27 opening wall. The tubing 50 may then be pulled down through the central cylindrical core 27 of the cassette 10.

An item of waste may be placed in an opening formed by the flexible tubing 50 which may then be twisted to seal and enclose the waste and its odor therein. The twisting can be done manually or by other rotational mechanism (such as described by the key 60 described in FIGS. in FIGS. 5 and 17-20) which may be used in combination with various features of the cassette 20. Various methods for closing off the opening of the flexible bag 50 may be employed by a variety of different containers units adapted for use with the cassette 10.

As shown in exploded view in FIG. 9, the top edge 29 of the central cylindrical core 27 may be slightly expanded. The upper end of the top edge 29 expanded portion may be flat or a curved edge (as shown) to prevent damage to the tubing 50 as the tubing 50 is passed thereover. The top edge 29 of the central cylindrical core 27 opening may be made of a material having a low coefficient of friction that promotes the smooth sliding interaction of the tubing 50 over the top edge 29 of the central cylindrical core 27. Likewise, the tubing itself may be constructed of a material having a low coefficient of friction property.

As the flexible tubing 50 is withdrawn from container, the packed tubing 52 shrinks downwards in the U-shaped lower annular body 20 from the elevated packed position shown in FIG. 6. To prevent the annular cover 40 from dropping below the upper end of the annular body 20 and becoming wedged in the lower casing of the lower annular body 20 and/or inhibiting the free flow of the packed tubing 52 outward from the lower annular body 20, the concentric outward flared angular wall 25 is formed in the lower annular body 20 between the outer wall 24 and the expanded outer wall 26 and acts as a vertical stop to prevent the lower end 45 of the annular cover 40 from falling lower than the height of the angular wall 25.

Figure 11:
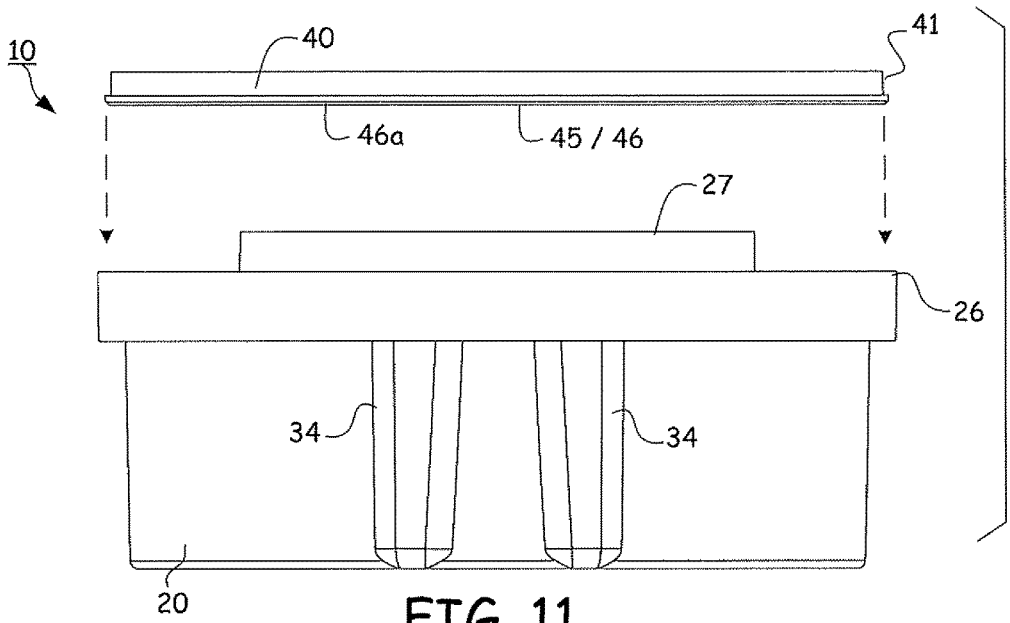
FIG. 11 shows an exploded side view of the annular cover being lowered onto the annular body of the cassette.

After the flexible tubing 50 has been packed into the lower annular body 20 as packed tubing 52, the annular cover 40 may then be placed over, and pushed into the U-shaped lower annular body 20 (as shown in FIG. 11) with sufficient force to cause the annular V-shaped groove 45 to snap past the ends 30*a* of the protruding tongues 30 which will then take up positions to prevent the annular cover 40 from rising off of the U-shaped annular body 20 as shown in FIGS. 9 and 12.

It is to be understood that various modifications to the cassettes 10 described above may be made without departing from the scope of the following claims. For example, instead of employing the use of an annular V-shaped groove in the annular cover 40 that matingly interlocks with a protruding tongue 30 in the expanded outer wall 26, small dimples, shallow protuberances and/or even shallow embossed grooves may be integrated in the respective mating parts to form a secure connection between the annular cover 40 and the lower annular body 20. For example, thermoplastic body dimples (not shown) may be formed on an inner surface 28 (as shown in FIGS. 9-10) of the expanded outer wall 26 casing (by the external application of hot points, or the like) to engage a circumferential groove disposed on the outside wall of the cylindrical outer wall 41 of the annular cover 40. Various alternatives are envisioned according to the subject matter of this disclosure. Any suitable configuration is to be understood, such as reversing the position of the circumferential groove and dimples in their respective positions, and/or like similar construction.

The flexible tubing 50 may be made in a variety of different sizes and shapes. For example, the flexible tubing 50 may be constructed of approximately 3 to 9 inches in diameter. Likewise, the diameter of the central cylindrical core 27 may be configured in various sizes and shapes, such as for example, approximately 3 inches. The flexible tubing 50 may be scented to counteract the malodor present in the waste being disposed of within the flexible tubing 50. The scenting may be impregnated into the composition if the flexible tubing 50 or applied to a surface of the flexible tubing 50.

Referring back to FIG. 5, the central cylindrical core 27 may be a continuous equidistant diameter or may be angled so that one end 27*a* is narrower than the other end 27*b* of the central cylindrical core 27. FIGS. 5 and 6 demonstrate an example of the upper end 27*a* of the central cylindrical core 27 having a smaller diameter, and the lower end 27*b* of the central cylindrical core 27 having a larger overall diameter.

The size and shape of the cassette 10 may take any suitable size and/or shape, such as oval, rectangular, and/or any other suitable size or shape according to this subject disclosure. The figures shown are merely exemplary and a wider range of sizes is possible according to this subject disclosure.

The lower annular body 20 or cover 40 of the cassette 10 may be composed of a variety of suitable materials according to the subject disclosure. For example, the various parts may be made of a rigid plastic material, such as poly polypropylene and/or any other suitable material capable of forming a secure snap fit connection to one another. The flexible tubing 50 may be formed of a barrier film capable of sealing and reducing the odors of the waste material within the flexible tubing 50 in accordance with this disclosure.

The illustrations and examples provided herein are for explanatory purposes and are not intended to limit the scope of the appended claims. It will be recognized by those skilled in the art that changes or modifications may be made to the above described embodiment without departing from the broad inventive concepts of the invention. It is understood therefore that the invention is not limited to the particular embodiment which is described, but is intended to cover all modifications and changes within the scope and spirit of the invention.

What is claimed:

1. A cassette for use in dispensing pleated tubing, comprising:

an annular body having a generally U shaped housing with a central cylindrical core;

an annular cover extending inward over the annular body defining a gap, the cover being secured to the body; and at least one elongated boss adapted to receive a key element, the elongated boss disposed on an outer surface of the annular body that extends from a lower end to an upper end of the annular body;

wherein a pair of adjacent elongated bosses define a gap that extends from a lower end to an upper end of the annular body; the gap having a varying width dimension with a narrower upper end than a wider lower end.

2. The cassette recited in claim 1, wherein the elongated boss has a dimension that is narrower in a radial width than in a length.

3. The cassette recited in claim 1, wherein the pair of adjacent elongated bosses are disposed around the outer surface of the annular body as sets of adjacent elongated bosses.

4. The cassette recited in claim 1, wherein the gap is a blind face gap extending over the outer surface of the annular body.

5. The cassette recited in claim 1, wherein the gap is smaller in width than in a length, wherein the length extends from the lower end to the upper end.

6. The cassette recited in claim 1, wherein the annular cover has at least one radial gap for rotation or prevention of a rotation.

7. The cassette recited in claim 6, wherein the at least one radial gap is adapted to receive an indexing mechanism for rotation or prevention of a rotation.

8. The cassette recited in claim 7, wherein the indexing mechanism is a finger.

9. A cassette for use in dispensing a pleated tubing, comprising:

an annular body having a generally U shaped housing with a central cylindrical core;

an annular cover extending inward over the annular body defining a gap, the cover being secured to the body; and at least one elongated boss disposed on an outer surface of the annular body that extends from a lower end to an upper end of the annular body, wherein the elongated boss has a dimension that is narrower in a radial width than in a length;

wherein a pair of adjacent elongated bosses define a gap that extends from a lower end to an upper end of the annular body, the gap having a varying width dimension with a narrower upper end than a wider lower end.

10. The cassette recited in claim 9, wherein the elongated boss is adapted to receive a key and position the cassette at a predetermined height.

11. The cassette recited in claim 9, wherein the gap is smaller in width than in a length, and wherein the length extends from the lower end to the upper end of the annular body.

12. The cassette recited in claim 9, wherein the annular cover has at least one radial gap for rotation or prevention of a rotation.

13. The cassette recited in claim 12, wherein the at least one radial gap is adapted to receive an indexing mechanism for rotation or prevention of a rotation.

14. A cassette for use in dispensing a pleated tubing, comprising:

an annular body having a generally U shaped housing with a central cylindrical core;

an annular cover extending over the annular body defining a gap, the cover being secured to the body; and at least one elongated boss adapted to receive a key element, the elongated boss disposed on an outer surface of the annular body that extends from a lower end to an upper end of the annular body where the annular cover is provided, and wherein the elongated boss has a dimension that is narrower in width then in a length, wherein the length extends from the lower end to the upper end of the annular body;

wherein a pair of adjacent elongated bosses define a gap that extends from a lower end to an upper end of the annular body; the gap having a varying width dimension with a narrower upper end than a wider lower end.

15. The cassette recited in claim 14, wherein the gap is smaller in width than in a length, and wherein the length extends from the lower end to the upper end of the annular body.

16. The cassette recited in claim 14, wherein the annular cover has at least one radial gap which is adapted to receive an indexing mechanism for rotation or prevention of a rotation.

* * * * *